United States Patent [19]

Kupper et al.

[11] Patent Number: 4,791,943

[45] Date of Patent: Dec. 20, 1988

[54] CIGARETTE FILTER UNIT AND METHOD FOR THE PRODUCTION THEREOF

[75] Inventors: Alois Kupper, Morges; Serge Veluz, Echichens, both of Switzerland

[73] Assignee: Baumgartner Papiers S.A., Crissier, Switzerland

[21] Appl. No.: 899,473

[22] Filed: Aug. 22, 1986

[30] Foreign Application Priority Data

Aug. 26, 1985 [CH] Switzerland ..... 3665/85

[51] Int. Cl.[4] ..... A24D 3/04; A24D 3/02

[52] U.S. Cl. ..... 131/339; 131/340; 493/42; 493/45

[58] Field of Search ..... 131/344, 336, 339, 340; 493/42, 45, 43

[56] References Cited

U.S. PATENT DOCUMENTS 3,368,566 2/1968 Avedikian ..... 131/344

3,533,416 10/1970 Berger ..... 131/339

4,034,765 7/1977 Van Hall ..... 131/336

*Primary Examiner*—V. Millin

*Attorney, Agent, or Firm*—Watts, Hoffman, Fisher & Heinke

[57] ABSTRACT

In order, when a cigarette is being smoked, to reduce, or even reverse, the tendency of the condensate-content to increase, a cigarette filter unit is proposed in which at least one partition having at least two areas of different porosities and made of a material which allows smoke to pass through it, is arranged between each two filter elements aligned axially with one another in the flow cross section of the filter unit. In this connection, a first partition area is designed in such a manner that its permeability decreases as the portion of tobacco associated with the cigarette filter unit is smoked, the tobacco smoke, passing through the said cigarette filter unit, flowing increasingly through the second partition area.

25 Claims, 10 Drawing Sheets

CIGARETTE FILTER UNIT AND METHOD FOR THE PRODUCTION THEREOF

This invention relates to a cigarette filter unit within which are arranged sections of different design which alternate consecutively and are surrounded by a wrapping strip. The invention also relates to a method for producing such a cigarette filter unit.

While a cigarette is being smoked without a cigarette filter, with or without ventilation, or with a conventional cigarette filter, the amount of condensate in the smoke entering the smoker's mouth through the suction end of the cigarette as he smokes, increases relatively sharply, which is undesirable.

It is one object of the present invention to provide a cigarette filter unit which, in combination with a portion of tobacco secured to it, does not exhibit these disadvantages when the tobacco is smoked, or exhibits them only to a much smaller degree; in other words, with the aid of the filter, a constant or even a decreasing amount of condensate is obtained each time the smoker draws on the cigarette.

According to the present invention, in the case of a cigarette filter unit of the type referred to above, this object is accomplished by providing, between each two filter elements in axial alignment with one another in the flow section of the filter unit, at least one partition comprising at least two areas of different porosities and made of a material which allows smoke to pass and preferably filters it.

It has been found desirable for the filter elements to be surrounded by a wrapping tube consisting of at least two longitudinal strips of different porosities the wrapping tube being constricted or compressed between each two consecutive and spaced apart filter elements, so as to form the partition.

It may also be desirable for a partition, extending at right angles to the direction of flow in the filter unit, to be clamped between two consecutive filter elements, the partition being provided with at least two areas of different porosities and being made of a material which filters tobacco smoke.

It may also be desirable to use, for one area of the partition, a very fine fabric or a perforated foil in which the number, size and distribution of the openings is accurately defined.

The present invention is furthermore concerned with the production of a cigarette filter unit which is characterized in that a series of filter elements, spaced uniformly apart, are wrapped, over a portion of their peripheries, by means of at least one continuously fed, first, porous wrapping strip and are connected to this first wrapping strip, the remaining uncovered surface area of the strand thus formed being there after completely covered by means of at least one continuously fed second wrapping strip differing from the first wrapping strip in porosity and connecting the said second strip, along its two lateral edges, to the first strip. The tube thus formed by the two wrapping strips is then fully constricted, or clamped together, at at least one location between each two filter elements, the clamping location being glued, and the rod-shaped unit thus formed, and containing the spaced apart filter elements, being completely enclosed in at least one wrapping strip.

The invention will now be described in greater detail, by way of example, with reference to the accompanying drawings, in which:

FIGS. 1 to 4 illustrated diagrammatically the production of one example of embodiment of a cigarette filter unit according to the invention;

Figure 10A:
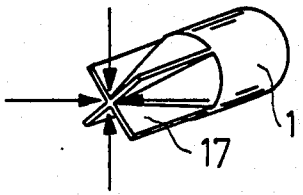
Figure 10:
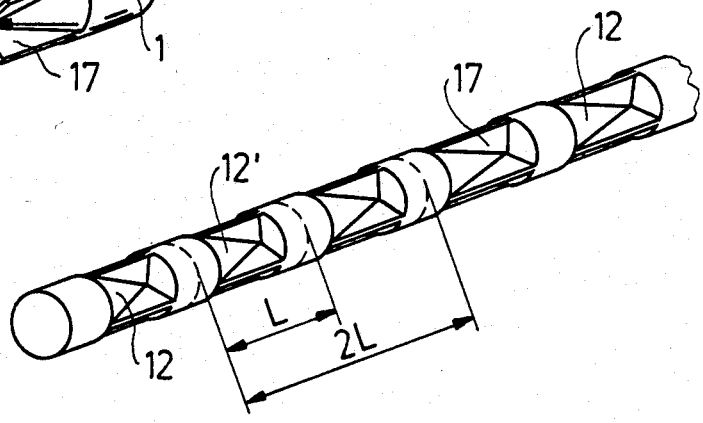
Figure 11A:
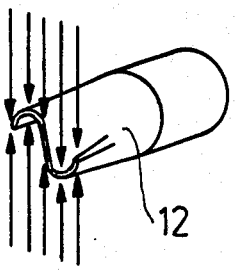
Figure 11:
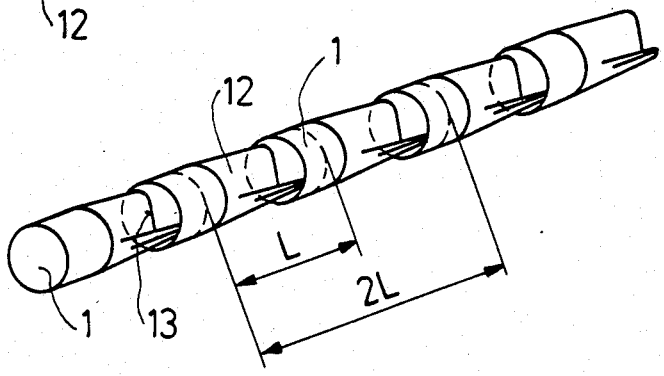
Figure 12:
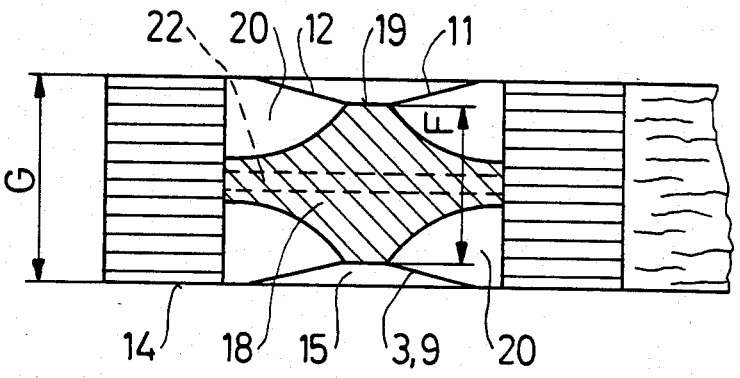
Figure 13:
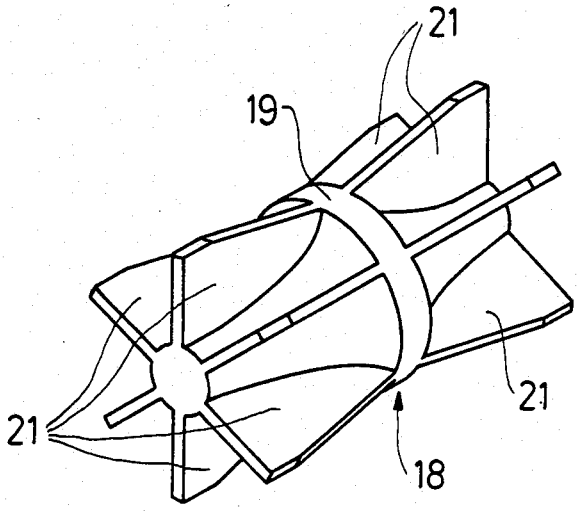
Figure 14:
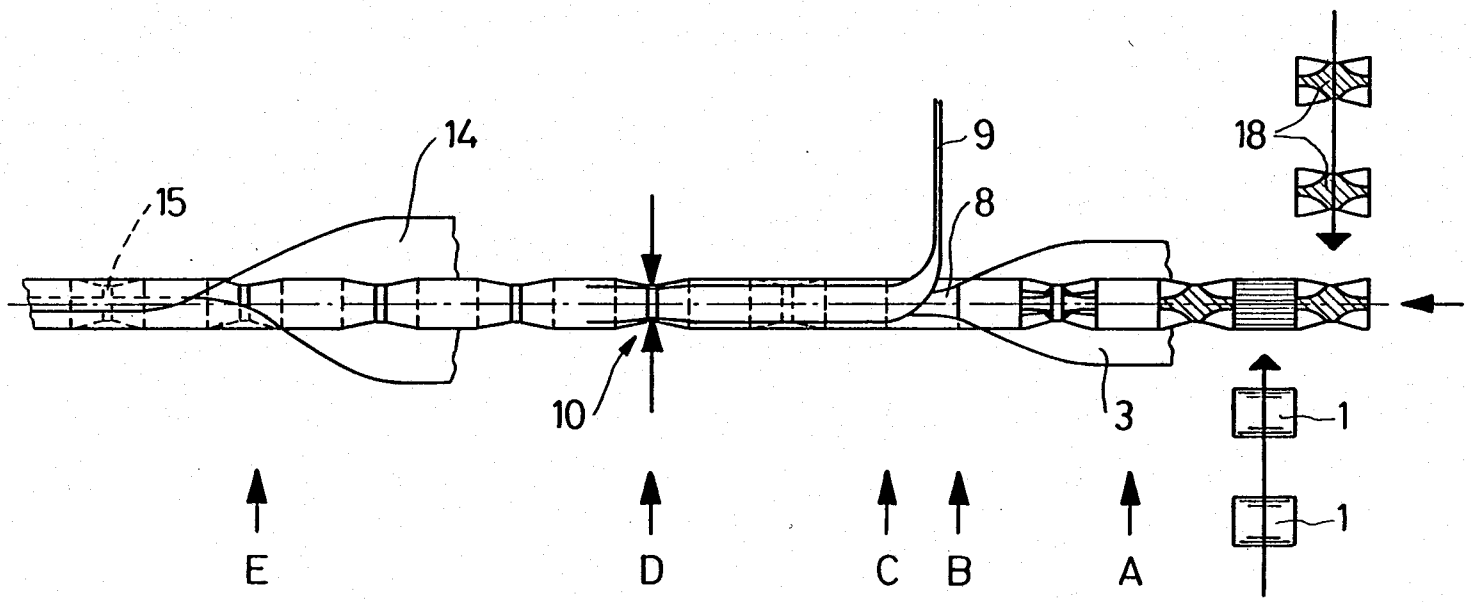
Figure 15:
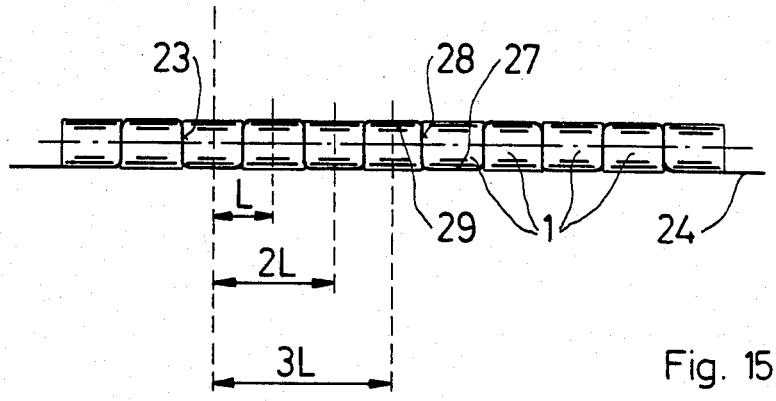
Figure 16:
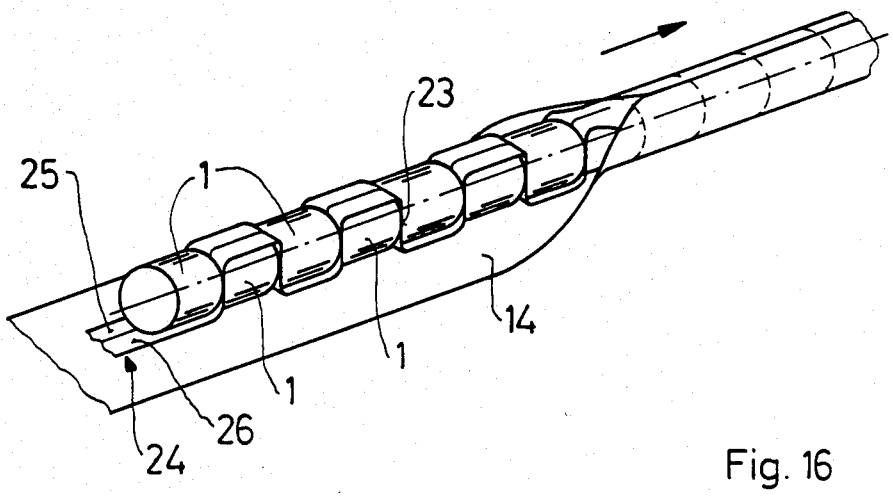
Figure 17:
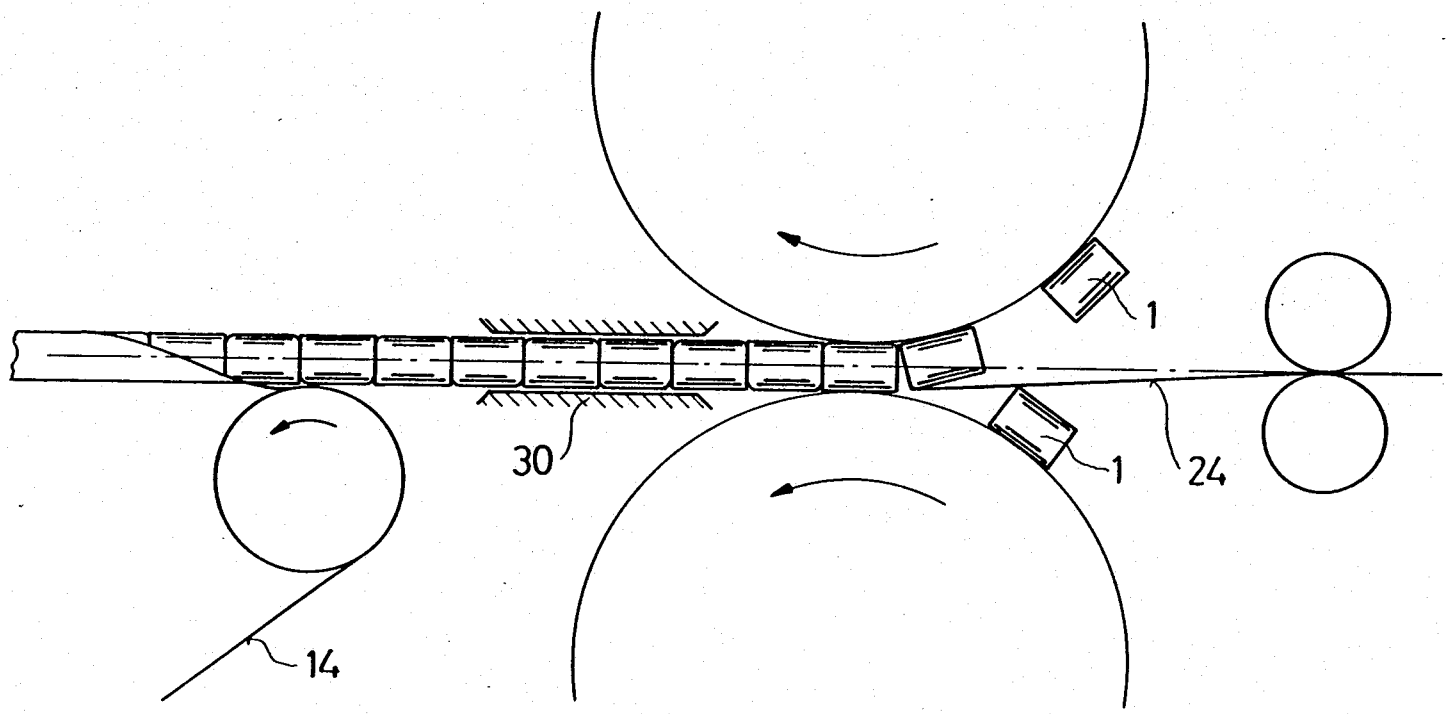
Figure 18:
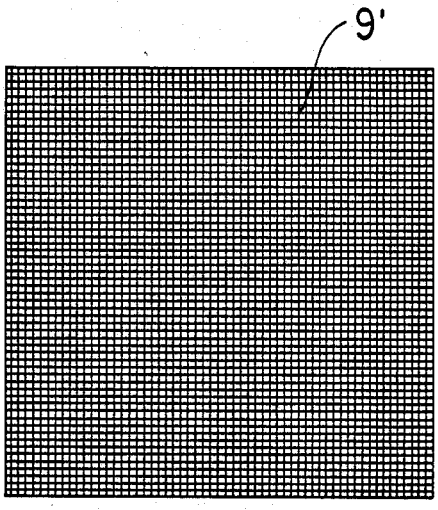
Figure 19:
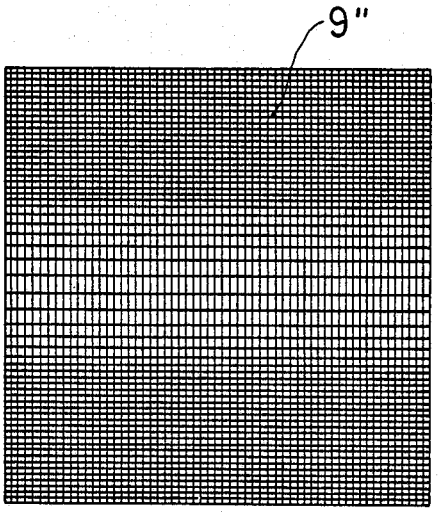
Figure 20:
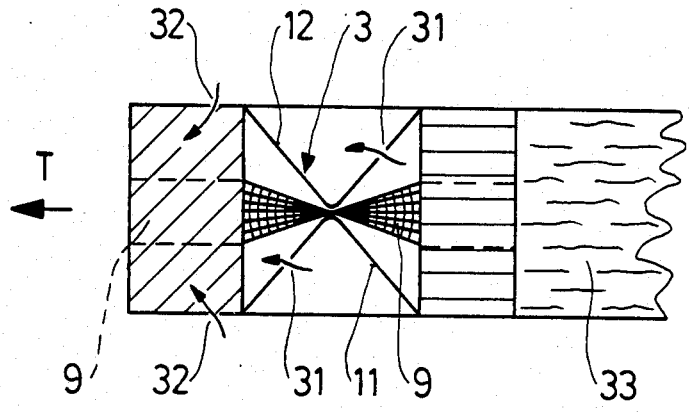

FIGS. *7a, 7b, 8a, 8b, 9a* and *9b* are perspective crossectional views showing various examples of cigarette filter units according to the invention, in FIGS. *7a, 8a* and *9a* without the wrapping strip and in FIGS. *7b, 8b* and *9b* with the wrapping strip;

FIG. 10 is a perspective view of a fourth example of a cigarette filter strand without the wrapping strip;

FIG. 10*a* is a diagrammatic perspective view showing the production of the strand shown in FIG. 10;

FIG. 11 shows, in perspective, a fifth example of a cigarette filter strand without the wrapping strip;

FIG. 11*a* is a diagrammatic perspective view illustrating the production of the strand shown in FIG. 11;

FIG. 12 shows a longitudinal section through a sixth example of a cigarette filter unit according to the invention;

FIG. 13 shows, on an enlarged scale, a perspective view of the spacing element in the filter unit shown in FIG. 12;

FIG. 14 illustrates diagrammatically the production of the filter unit shown in FIG. 12;

FIGS. 15 to 17 illustrate diagrammatically the production of another example of a cigarette filter unit according to the invention;

FIGS. 18 and 19 show sections from two different strips of fabric made from polymer fibres and forming the first partition area; and FIG. 20 shows a longitudinal section through the mouth end of a filter cigarette fitted with a cigarette filter unit according to the invention.

As will be understood from FIGS. 1 to 4, in the method illustrated, filter elements 1, which are made out of cellulose or acetate, are moved forward in the direction of the arrow 2, in known fashion, by means of a conventional transporting and spacing device, not shown, which aligns the filter elements alternatingly and axially with each other, at the same time spacing them uniformly apart.

Thereafter, the uniformly spaced and axially aligned filter elements are fed continuously to a porous wrapping strip 3, which is also continuously fed, upon which they are placed, being guided laterally by guide-means, not shown. They are held in position relatively to one another by a pressure belt, also not shown, arranged above the wrapping strip 3, and are moved forward in synchronism with the pressure belt together with the wrapping strip 3.

On the side facing filter elements 1, the wrapping strip 3 carries a previously applied heat-softenable adhesive by means of an adhesive-applying device 4, in strips 5 and 6 to the wrapping strip. This makes it possible for individual filter elements 1, immediately after they have been transferred to the wrapping strip 3, to be secured thereto by means of a heating unit (FIG. 1, location A), thus preventing displacement in relation to each other, i.e. a change in spacing (FIG. 2). In this connection, wider adhesive strips 5 serve to secure the filter elements 1 to the wrapping strip 3, while narrower adhesive strips 6 serve to establish the subsequently effected constriction (FIG. 1, location D) of the wrapping tube 7.

After the individual filter elements 1 have been secured to the porous wrapping strip 3, the latter is passed to an endless conveyor-belt. These parts then proceed together to a two-part forming unit, now shown (FIG. 1, location B) where the wrapping strip, as it moves forward to a slot 8 measuring between 4 and 6 mm, is placed around the filter elements 1 having a circumference of 25 mm. By means of the conveyor-belt, this structure is then passed, to complete the gluing of the wrapping strip 3 to the filter elements 1, and for accurate fixing of the filter diameter, first under a second heating unit covering the upper half of the strand and, directly thereafter, under a second cooling element also covering the upper half of the strand, as described for example in German Pat. No. 25 55 129.

Thereafter, a closing strip 9, which is considerably more porous than the wrapping strip 3, and the width of which is slightly greater than the width of the slot 8, is fed from above, laid over the slot 8 (FIG. 1, location C), and is glued, by means of a heated element, to the exposed surfaces of the filter elements 1 and the lateral edges of the wrapping strip 3, by softening the thermoplastic coating on the closing strip. In order to obtain an accurate external configuration of the strand thus formed, this strand, equipped with the heated closing strip 9, is passed under a water-cooled cooling element where the softened thermoplastic coating of the closing strip solidifies.

Figure 4:
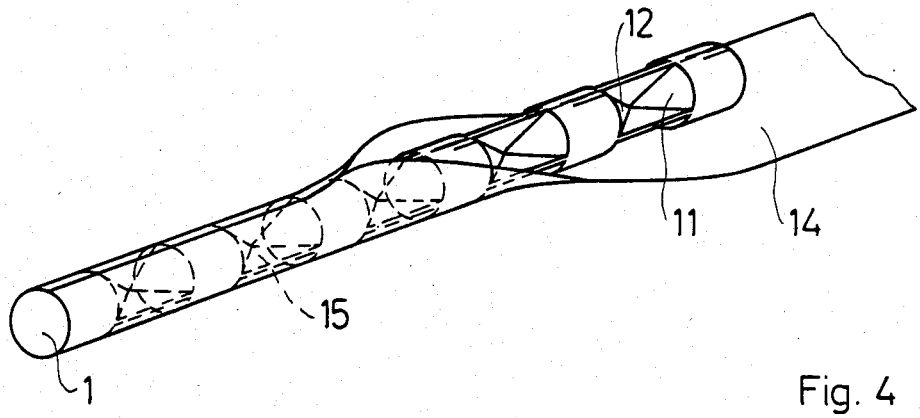
Figure 5:
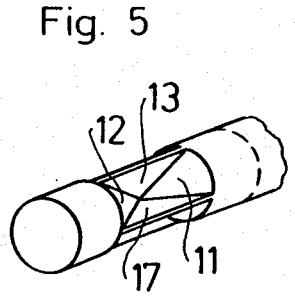
FIG. 5 is a perspective view of the cigarette filter unit produced in accordance with FIGS. 1 to 4, but without the wrapping strips, in order to provide a better view of the partition.
Figure 7A:
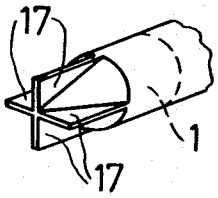
Figure 7B:
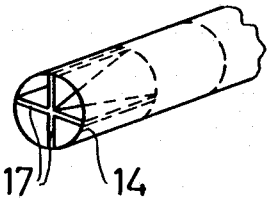

After the strand has been thus glued by means of the two strips 3 and 9 of different porosities, it is passed to a clamping arrangement 10 (FIG. 1, location D) where the wrapping tube, formed from the two strips 3 and 9, is compressed and constricted between each of two consecutive elements spaced from one another, as may be seen more particularly in FIGS. 4 and 5, thus forming two conical tube sections 11 and 12 with their apices facing towards one another; the conical surfaces comprise two areas of different porosities corresponding to those of the strips 3 and 9. The jaws of the clamping arrangement 10 are heated so that the clamping location 13 of the tube 3, 9 is fixed.

Figure 1:
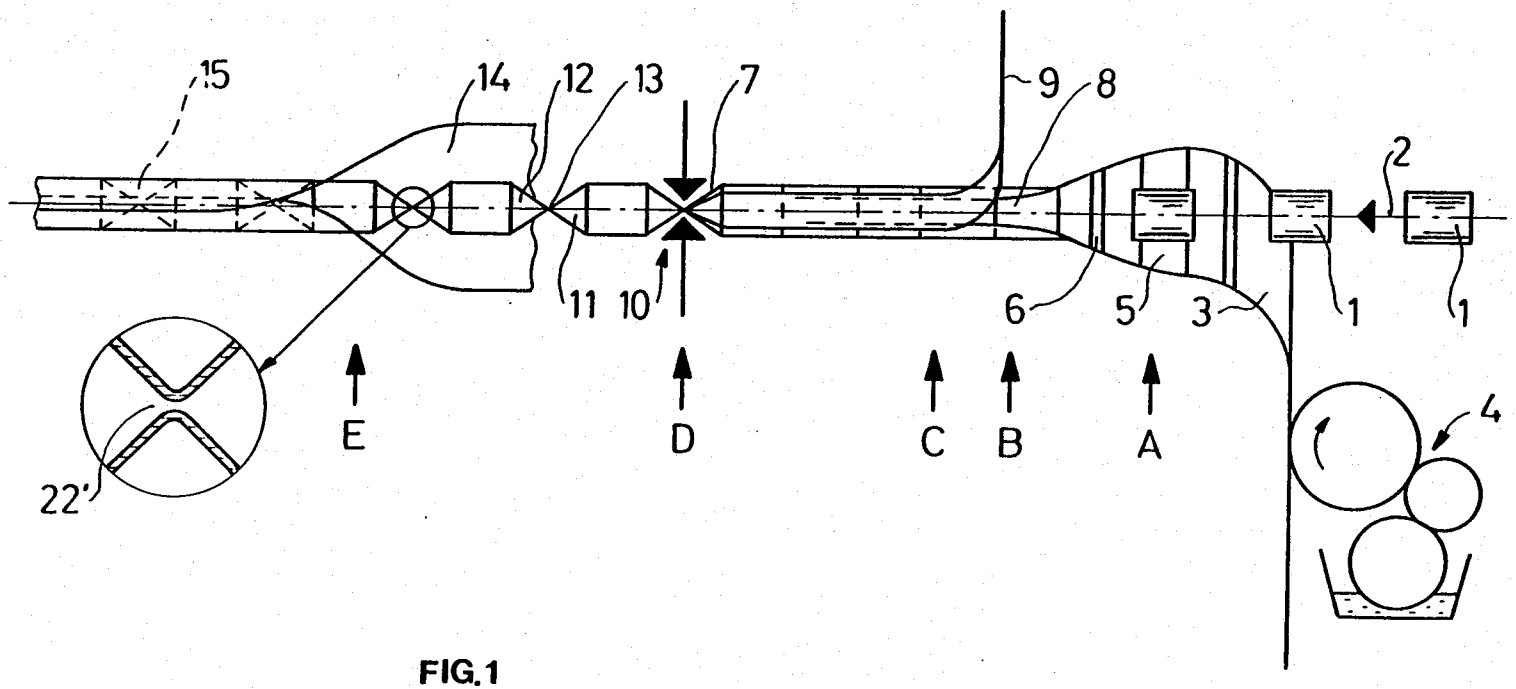
Figure 2:
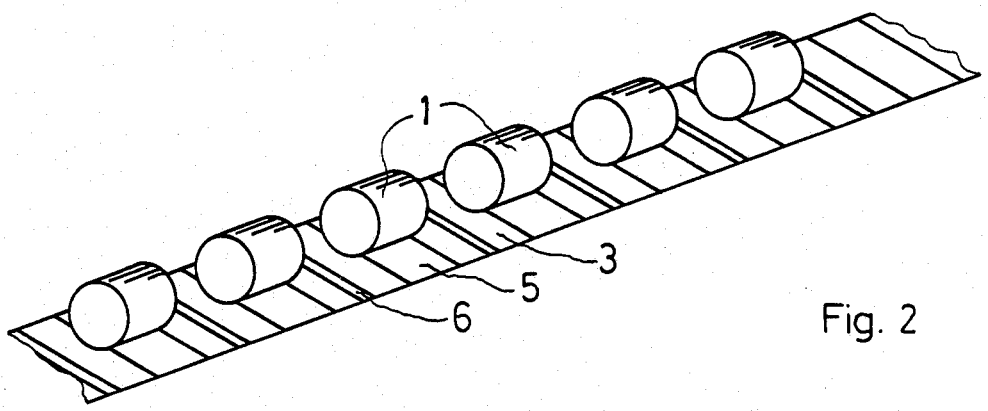
Figure 6:
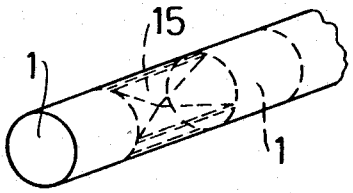
FIG. 6 is a perspective view of the unit shown in FIG. 5, but with the enclosing wrapping strip.
Figure 8A:
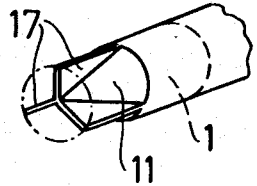
Figure 8B:
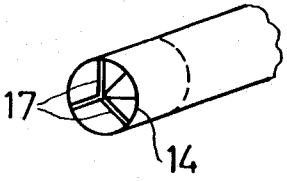
Figure 9A:
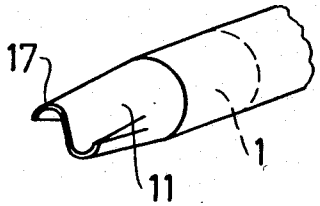
Figure 9B:
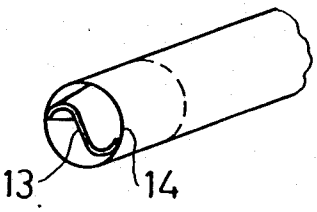

The rod-shaped unit thus formed, and containing the spaced filter elements and the constricted tube sections, is then completely enclosed, in known manner, by mean s of a porous or non-porous wrapping strip 14 (FIG. 1, location E). The latter is glued and the strand, thus formed continuously, is fed to a parting device where it is devided in such a manner that the length of each filter plug is, as usual, four or six times the length of a single filter intended for a cigarette (FIG. 6).

When a portion of tobacco connected to this cigarette filter is smoked, the smoke from the latter flows first through filter element 1 arranged on the tobacco side and then from the interior of the conical tube section 11, through the conical area of section 11 formed by the porous strip 9, into an annular chamber 15. It flows thence through the conical area formed by the porous strip 9 of the tube section 12 into the interior thereof and then through the filter element 1 on the mouth side. As the porous areas, formed by the strip 9 of the conical tube sections 11 and 12 are increasingly blocked by the constituents filtered out of the smoke, the smoke drawn in flows increasingly through the low porosity areas of the conical tube sections 11 and 12 formed by the strip 3. Thus, by suitable selection of the different porosities of the strips 3 and 9, when a cigarette fitted with a filter of this kind is smoked, it is possible to obtain an approximately constant resistance to suction and thus a uniform release of aroma, in contrast to the past.

The annular chamber 15, formed between the conical tube sections 11 and 12 and wrapping strip 14, may be filled with freely flowing filter material, described in German Pat. No. 25 55 129, for example.

Figure 3:
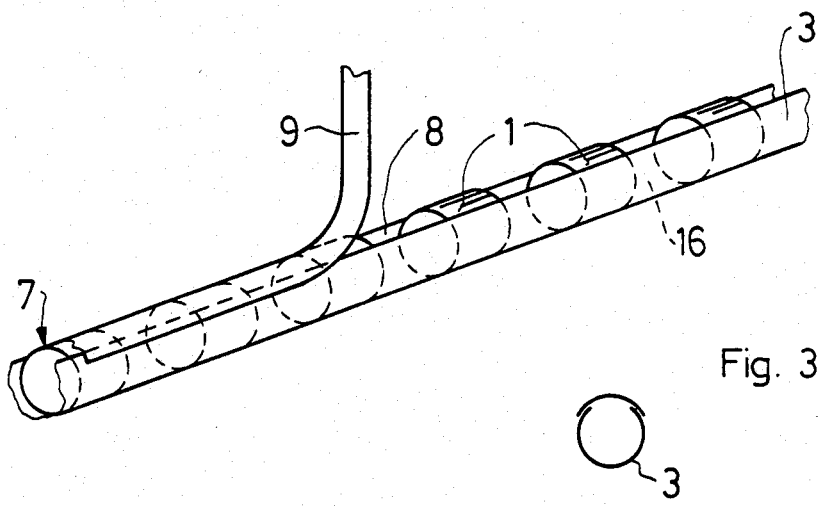

It is, of course, also possible to fill the chambers formed in the conical tube sections 11 and 12 with freely flowing filter material in which case the latter must be introduced between locations B and C (FIG. 1), into chambers 16 formed between adjacent filter elements 1 and the wrapping strip 3 (FIG. 3).

Reinforcing ribs 17, formed simultaneously, upon constriction of tubes 3, 9, by means of the clamping arrangements 10 (FIGS. 5 and *7a*), provide advantageous reinforcement of the rod thus forced, for further processing and for the finished filter.

FIG. *7b* is a cross section through the finished filter according to FIG. 6.

Like FIG. *7a*, FIGS. *8a* and *9a* show perspective views of two other constriction variants.

FIGS. *8b* and *9b* are cross sections, corresponding to FIG. *7b*, through the corresponding finished filter units.

FIGS. 10 and 11 show two further constriction variants. In these cases the constrictions, shown in FIGS. *10a* and *11a*, are effected directly adjacent the end face of one of the filter elements so that a filter length L always comprises only one conical chamber 12' formed by a tube 3, 9, whereas the example illustrated in FIG. 5 comprises two such chambers 11, 12.

In the embodiment of a cigarette filter unit illustrated in FIG. 12, during its manufacture, as illustrated diagrammatically in FIG. 14 which is substantially similar to the manufacturing process shown in FIG. 1 and need therefore not be described again in detail, a spacing element 18 is arranged between spaced apart filter elements 1, bearing against the opposing end faces thereof. The spacing element is shown, on an enlarged scale, in FIG. 13.

In order to ensure that, when the cigarette is being smoked, the smoke to be filtered flows transversely through the wrapping tube formed by the strips 3, 9 of different porosities, the spacing element 18, designed to be impermeable to gas, is provided over a part of its length with an annular attachment area 19, the diameter F of which is smaller than the inside diameter G of the outer sheath 14. The wrapping tube 3, 9 is secured sealingly around the entire circumference of the attachment area. Furthermore, the spacing element 18 is provided with supporting ribs 21 extending radially for the purpose of centering it in the interior of the wrapping tube 3, 9 and, at the same time, forming flow-channels.

In FIG. 14, parts and locations similar to those in FIG. 1 bear the same references.

In the embodiment illustrated in FIG. 12, it is conceivable for the wrapping tube to be made of a single porous strip, for the spacing element 18 to be made of a material which is permeable to gas, and for the flow resistance of the latter to differ from that of the material from which the wrapping tube 3 is made. If the flow resistance of the latter is less than that of the spacing element 18, then the smoke to be filtered flows first from the tobacco-side filter element 1, over the truncated-conical surface 11, from inside to outside, and then into the annular chamber 15. From there it flows over the truncated-conical surface 12, from outside to inside, and through the mouth-side filter element 1. As the truncated conical surfaces 11 and 12 are increasingly blocked by filtered out smoke and gas components, the flow of smoke and gas to be filtered passes more and more through the spacing elements 18 which has a higher flow resistance.

It is also possible, if the spacing element 18 is made of a material impermeable to gas, to provide it, in its longitudinal direction, with one or more quite fine passages 22 having a diameter of about 1/100 mm.

In the cigarette-filter strand illustrated in FIG. 15, a partition 23, running at right angles to the direction of flow in the filter unit is clamped between each two consecutive filter elements 1, the partition being provided with two areas of different porosities and being made of a material which filters tobacco smoke. The said partition is made of a strip of paper 24 comprising two areas 25 and 26, of different porosities, running parallel in the longitudinal direction, or made up of two different strips.

As may be seen from FIGS. 16 and 17, the paper strip 24 thus produced is arranged alternatingly, first along the outer side 27 of one filter element 1, then transversely across its end face 28, and then along the opposite outer side 29 of following filter element 1. The whole is then drawn through a calibrating orifice 30, after which it is completely enclosed by a wrapping strip 14 and glued.

As in the case of the preceding examples, the strand thus formed is fed to a parting device where it is divided in such a manner that the length of each filter structure is four or six times the length of a single filter intended for a cigarette. The length of a single filter may be L, 2L, 3L, etc., for example.

It is, of course, also possible to produce the strip 24 with only one porosity. If such a strip is used, however, it is impossible to keep the flow resistance in the filter approximately constant during the smoking of a portion of tobacco secured to it.

FIGS. 18 and 19 are plan views of sections of two different strips of fabric made of polymer fibres to be used in forming a partition area; in other words, the closing strip 9 in FIGS. 1 to 4 and 14, for example, and the strip 25 in FIGS. 15 to 17, may be made of such a material.

In the strip of fabric shown in FIG. 18, the geometrical distribution of the openings, and the cross sections thereof, are completely uniform.

Fabric strip 9', used for example in FIG. 1 to form a partition area 9, and shown in FIG. 18, is not intended in the finished cigarette filter unit to filter aerosols out of a flow of smoke-gas mixture passing through it. Although the filtering capacity of this fabric strip for the particle phase of the flow of smoke-gas mixture passing through is measurable, it is negligible in practice; in the finished filter, the fabric strip portion 9 mainly performs the function of a bypass. To this end it must be very thin, so that the first partition area produced from it produces a relatively low initial flow resistance when the finished filter is in use. The effect of the fabric 9' forming the first partition area 9 is such that, when a smoke-gas aerosol flowsthrough it, a very small number of aerosol particles adhere to the fabric 9'. However, this number is large enough to cause a marked reduction in the free cross sections of the openings in the fabric, and thus a major increase in the flow resistance produced by the fabric 9' thus charged. For this reason, the thickness of the fabric 9' is between 30 and 100 $\mu$m, the number of openings in the fabric is between 500 and 25,000, and the cross sections of the individual openings in the fabric are between 100 and 2500 $\mu m^2$.

In order to ensure that when cigarette filter units according to the invention are mass-produced, it is possible to obtain accurately reproducible characteristics. The fabric 9' must not be made of a material in which the spatial distribution of the openings is haphazard or in which the cross sectional areas or shapes of the openings are haphazard.

It has therefore been found desirable for the distance between individual openings in the fabric section constituting the first partition area 9, and the magnitude of the cross sectional areas of these openings, to vary by less than 10% from the predetermined value.

In the case of the cigarette filter unit illustrated in FIG. 20, and the comprising a closing strip 9 made of a fabric strip 9', according to FIG. 18, ventilation openings 32 are provided after the partitions 11 and 12, as seen in the direction of flow T in the filter unit, and running between the interior and the exterior of the filter unit. The number and cross section of the ventilation openings are such as to produce a 50% initial dilution of the smoke drawn from portion 33 of tobacco.

Now if a cigarette fitted with a filter such as that shown in FIG. 20 is smoked, then smoke from the smoker's first draw on the lighted cigarette flows with a relatively small initial pressure drop (30 mm head of water, for example) through the fabric strip 9 in the partitions 11 and 12, aerosol particles contained in the tobacco smoke adhering to these fabric sections in the partitions 11 and 12. With each draw on the suction end of the filter unit, the free cross sections of the individual openings through which the smoke passes decrease in size, while the pressure drop, caused by the fabric sections in the partitions 11 and 12, becomes increasingly higher. Thus, during the smoking of a portion 33 of tobacco, as the fabric sections through which the smoke flows become increasingly blocked by smoke-aerosol particles, more air from the ventilation openings 22 is mixed with the smoke drawn in by the smoker. As a result of this, the concentration of tobacco smoke entering the filter, which increases as the portion 33 of tobacco becomes shorter, is again increasingly diluted with air after the partitions 11 and 12. The concentration of the smoke drawn in by consecutive draws of the smoker can therefore be kept constant within relatively narrow limits, in contrast to the past. Moreover the aroma of the smoke drawn in by the smoker remains practically unchanged throughout the time taken to smoke the portion 33 of tobacco. If desired, the aroma may even decrease, which was not so in the pst.

The wrapping strip 3, used in the embodiment illustrated in FIG. 20, may be made of a material permeable to air or also of a material practically impermeable to air for the smoker. In the latter case in particular, the partitions 11 and 12 must in any case be provided with a plurality of excess flow openings 31. The cross sections of these openings must be such that they are at least ten times larger than the largest openings in the fabric section 9' constituting the second partition area. A design of this kind makes it possible to maintain a minimal flow of smoke-gas mixture when the fabric areas 9 are almost or completely blocked.

In the case of the fabric strip 9'' shown in FIG. 19, in contrast to the fabric strip 9' in FIG. 18, the geometrical distribution of the openings, and the cross sections thereof, vary. However, it is not haphazard. Instead, the distribution is accurately predetermined over the entire length of the strip.

Other designs of fabric strip are, of course, also conceivable.

We claim:

1. A cigarette filter unit within which are arranged sections of different designs which alternate consecutively and are surrounded by a wrapping strip, characterized in that arranged between each two filter elements, in axial alignment with each other in the flow section of the filter unit, is at least one partition, each partition comprising at least two areas of differing porosities defined by porosity openings, the size of the porosity openings in one area having a greater cross-section than the porosity openings in another area, and each of said at least two areas made of a material which allows smoke to pass and preferably filters it.

2. A cigarette filter unit according to claim 1, characterized in that the filter elements are surrounded by a wrapping tube consisting of at least two longitudinal strips of different porosities, the wrapping tube being constricted or compressed between each two consecutive and spaced apart filter elements, thereby to form the partition.

3. A cigarette filter unit according to claim 2, characterized in that the longitudinal strip of the wrapping tube having greater porosity forms at the most one third, preferably at the most one quarter, of the outer periphery of the tube.

4. A cigarette filter unit according to claim 2 characterized in that at least one of the three chambers formed between two filter elements is filled with a freely flowing filter material.

5. A cigarette filter unit according to claim 2, characterized in that a passage extending in the axial direction of the filter unit and having a diameter of, at the most, 1/10 mm, preferably about 1/100 mm, is provided at the location of the constriction in the partition.

6. A cigarette filter unit according to claim 1, further comprising an outer sheath made of a highly porous or perforated wrapping strip.

7. A cigarette filter unit according to claim 6, characterized in that the outer sheath has an external ribbed configuration at least over a part of its length.

8. A cigarette filter unit according to claim 6, characterized in that a spacing element is arranged between each of the spaced apart filter elements, and bears against the opposing end faces thereof, the spacing element being provided, over a part of its length, with an attachment area whose diameter is smaller than the inside diameter of the outer sheath of the cigarette filter unit, the wrapping tube being connected to the attachment area over the entire periphery thereof.

9. A cigarette filter unit according to claim 8, characterized in that the spacing element is made of a material permeable to gas and is provided, in its longitudinal direction, with a passage having a diameter of, at the most, 1/10 mm, preferably about 1/100 mm.

10. A cigarette filter unit according to claim 8, characterized in that the spacing element is provided with supporting ribs running radially for the purpose of centering it in the interior of the wrapping tube and, at the same time, forming flow-channels.

11. A cigarette filter unit according to claim 8, characterized in that the spacing element is made of a material permeable to gas, the flow-resistance thereof differing from that of the material of which the wrapping tube is made.

12. A cigarette filter unit according to claim 1, characterized in that a partition, running at right angles to the direction of flow in the filter unit, is clamped between two consecutive filter elements, the partition being provided with at least two areas of different porosities, and being made of a material which filters tobacco smoke.

13. A cigarette filter unit according to claim 12, characterized in that the area of the partition exhibiting greater porosity forms, at the most one third, preferably at the most one quarter, of the partition.

14. A cigarette filter unit according to claim 12, characterized in that the partition is made out of a strip of paper which runs alternatingly, first along the outer side of the one filter element, then transversely across the end face thereof, and then along the opposing outer side of the subsequent filter element.

15. A cigarette filter unit according to claim 14, characterized in that the strip of paper comprises at least two areas of different porosities which run longitudinally parallel with one another.

16. A cigarette filter unit according to claim 1, characterized in that at least the first partition area is made of a material the thickness of which is between 10 and 150 $\mu$m, the number of openings provided in this material being between 500 and 25,000, and the cross-sectional area of these openings being each between 80 and 3000 $\mu m^2$; and further characterized in that the second partition area is provided with at least one flow opening the cross section of which is 10 times larger than that of the largest opening in the first partition area.

17. A cigarette filter unit according to claim 16, characterized in that the thickness of the first partition area is between 30 and 100 $\mu$m and the cross-sectional area of the individual, screen-like openings provided in the said first partition area is between 100 and 2500, preferably between 100 and 1800 $\mu m^2$.

18. A cigarette filter unit according to claim 16, characterized in that at least the first partition area is made of natural textile and/or synthetic fibres.

19. A cigarette filter unit according to claim 16, characterized in that the distance between individual openings in the first partition area and the magnitude of the cross-sectional areas of these openings, varies by less than 10% from a predetermined value.

20. A cigarette filter unit according to claim 16, characterized in that the first partition area comprises different cross-sectional areas according to an accurately predetermined distribution, the magnitude thereof being accurately determined.

21. A cigarette filter unit according to claim 16, characterized in that at least one said partition area is provided with one or more excess flow openings the individual cross-sectional areas of which exceed $10^4$ $\mu m^2$.

22. A method for producing the cigarette filter unit claimed in claim 1, characterized in that a series of filter elements, spaced uniformly apart, are wrapped, over a portion of their peripheries, by means of at least one continuously fed, first, porous wrapping strip and are connected to this first wrapping strip, the remaining uncovered surface area of the strand thus formed being thereafter completely covered by means of at least one continuously fed second wrapping strip differing from the said first wrapping strip in porosity and connecting the said second strip, along its two lateral edges, to the said first strip; the tube thus formed by the two wrapping strips being then fully constricted, or clamped together, at at least one location between each two filter elements, the clamping location being glued, and the rod-shaped unit thus formed, and containing the spaced apart filter elements, being completely enclosed in at least one wrapping strip.

23. A method according to claim 22, characterized in that the tube formed by the two wrapping strips of different porosities is clamped between each two filter elements in such a manner as to produce at least one approximately conical tube section.

24. A method according to claim 23, characterized in that the tube formed by the two wrapping strips of different porosities is clamped between each two filter elements in such a manner as to produce two at least approximately conical tube sections having the tapered parts facing each other.

25. A method according to claim 23, characterized in that the tube section is clamped in such a manner as to form an at least approximately S-shaped clamping location.

* * * * *